US012193552B2

(12) United States Patent
Carlucci

(10) Patent No.: US 12,193,552 B2
(45) Date of Patent: Jan. 14, 2025

(54) MULTIPLE NOZZLE ATTACHMENT FOR HAIR DRYER

(71) Applicant: CONAIR CORPORATION, Stamford, CT (US)

(72) Inventor: Vito James Carlucci, Stratford, CT (US)

(73) Assignee: Conair LLC, Stamford, CT (US)

( * ) Notice: Subject to any disclaimer, the term of this patent is extended or adjusted under 35 U.S.C. 154(b) by 383 days.

(21) Appl. No.: 16/682,129

(22) Filed: Nov. 13, 2019

(65) Prior Publication Data

US 2021/0137239 A1 May 13, 2021

(51) Int. Cl.
*A45D 20/12* (2006.01)

(52) U.S. Cl.
CPC ..... *A45D 20/122* (2013.01)

(58) Field of Classification Search
CPC ..... A45D 20/122; A45D 20/12; A45D 19/00; A45D 19/02; A45D 20/00; A45D 20/124
See application file for complete search history.

(56) References Cited

U.S. PATENT DOCUMENTS 3,837,581 A * 9/1974 Orsoff ..... A45D 20/122 239/592
5,729,907 A * 3/1998 Santhouse ..... A45D 2/002 34/98
7,152,610 B2 * 12/2006 Csavas ..... A45D 2/002 132/271
D775,418 S 12/2016 Stephens et al.
D775,419 S 12/2016 Stephens et al.
D782,734 S 3/2017 Sutter et al.
D785,240 S 4/2017 Smith et al.
D785,241 S 4/2017 Stephens et al.
D798,502 S 9/2017 Smith et al.
D811,009 S 2/2018 Smith et al.
D833,069 S 11/2018 Broides et al.
D869,763 S 12/2019 Atkinson et al.
D872,935 S 1/2020 Kang
2004/0261812 A1 12/2004 Csavas
2005/0198854 A1 9/2005 Hobe
2005/0229423 A1 10/2005 Keong
(Continued)

FOREIGN PATENT DOCUMENTS

DE 295 03 297 U1 4/1995
EP 0970633 A1 * 1/2000
(Continued)

OTHER PUBLICATIONS

Conair Pro Concentrator Nozzle [online], [site visited Apr. 6, 2021]. Available from internet, URL: <<https://www.amazon.com/Conair-Pro-Concentrator-Nozzle/dp/B0012SC3M2/ref=sr_1_73?dchild=1&keywords=hair+dryer+dual+nozzle&qid=1617727232&sr=8-73> (Year:2016).

(Continued)

*Primary Examiner* — Edelmira Bosques
*Assistant Examiner* — Bao D Nguyen
(74) *Attorney, Agent, or Firm* — Ruggiero McAllister & McMahon LLC

(57) ABSTRACT

A multiple nozzle attachment for a hair dryer is provided. The multiple nozzle attachment has at least two nozzles that concentrate air flow and optimize exiting air pressure while maximizing air flow volume.

11 Claims, 15 Drawing Sheets

(56) References Cited

U.S. PATENT DOCUMENTS

| | | | | |
|---|---|---|---|---|
| 2008/0263887 | A1* | 10/2008 | Nakasone | A45D 20/12 34/97 |
| 2009/0320873 | A1* | 12/2009 | Silva | A45D 20/12 132/271 |
| 2017/0245614 | A1* | 8/2017 | Porter | A45D 20/122 |
| 2018/0140070 | A1 | 5/2018 | Hillebrecht et al. | |

FOREIGN PATENT DOCUMENTS

| | | | |
|---|---|---|---|
| EP | 2 534 971 | A1 | 12/2012 |
| EP | 007744792-0001 | | 3/2020 |
| JP | S 61 39006 | U | 3/1986 |
| WO | 2014/147460 | A1 | 9/2014 |

OTHER PUBLICATIONS

Argentine Office Action dated Oct. 20, 2023 from corresponding Argentine Patent Application No. 20200100732, 6 pages.

* cited by examiner

MULTIPLE NOZZLE ATTACHMENT FOR HAIR DRYER

BACKGROUND OF THE DISCLOSURE

1. Field of the Disclosure

The present disclosure relates to nozzle attachments for hair dryers. More particularly, the present disclosure relates to nozzle attachments for hair dryers that each minimize the decrease in air pressure while increasing the air flow volume emitting from the nozzle attachment more than conventional nozzle attachments.

2. Description of Related Art

Various types of attachments are used to alter air flow characteristics of the air exiting the barrel of a hair dryer. Current nozzle attachments increase the pressure of air exiting the barrel of a hair dryer while limiting the air flow volume exiting the barrel.

SUMMARY

It is an object of the present disclosure to optimize air flow volume of a hair dryer while, at the same time, optimizing pressurized, concentrated air flow by providing a single nozzle attachment for a hair dryer that has multiple nozzle concentrating portions (hereinafter called "multiple nozzle attachment").

The present disclosure provides for such a multiple nozzle attachment that minimizes the drop in pressure while maximizing air flow volume. In other words, the pressure of air exiting the multiple nozzle attachment is greater than the pressure of air exiting a singular nozzle attachment of equivalent, effective distal exit area.

DETAILED DESCRIPTION

Figure 1:
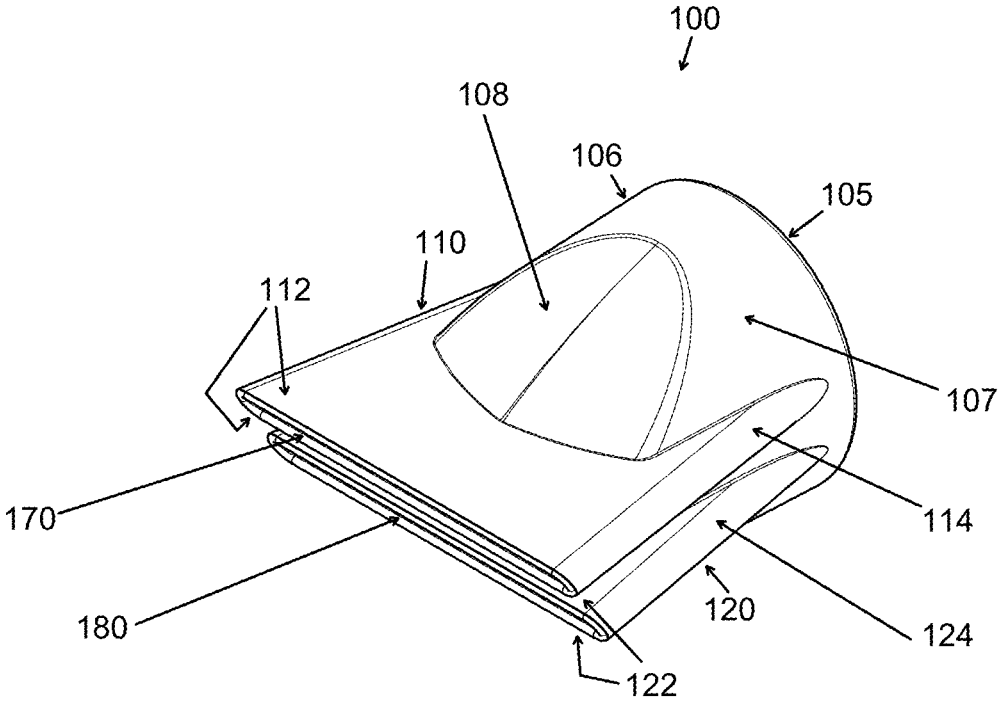
FIG. 1 is a top, front perspective view of an embodiment of a dual nozzle, nozzle attachment for a hair dryer according to the present disclosure.

Referring to the drawings and, in particular, FIG. 1, there is shown a multiple nozzle, nozzle attachment 100 of the present disclosure. As noted above, the multiple nozzle, nozzle attachment has two nozzle portions called a "dual nozzle" attachment 100 for the embodiment shown. Dual nozzle attachment 100 has an opening that is used to connect to the barrel or concentrator of a hair dryer (not shown). Opening 105 in the embodiment shown in FIG. 1, is a circular opening at the proximal or rear end of dual nozzle attachment 100. However, in other embodiments, opening 105 can be other shapes, such as rectangular, square, oval, elliptical, and triangular in order to fit hair dryer barrels or concentrators of similar shapes.

Dual nozzle attachment 100 has a first or top nozzle 110, and a second or bottom nozzle 120 both placed at the front or distal end of the dual nozzle attachment as shown. Attachment 100 has a body 106 tapered from opening 105 to connect with the first and second nozzles 110 and 120. The tapering includes a tapered portion 107 and a steep taper portion 108. The body portion 106 has basically a conical shape with a wider circumference at opening 105 than the circumference at the topmost area where tapered portion 107 and steep taper portion 108 meet or where body 106 connects to nozzles 110 and 120. In this embodiment, nozzles 110 and 120 are shaped as rectangular structures having a pair of side walls 112 and 122, respectively, with curved edges 114 and 124 respectively, as shown, that together form similarly shaped distal end openings 170 and 180, respectively, at the distal ends or tips. In some embodiments each of the sidewalls 112 is parallel to each other, and each of the sidewalls 122 is parallel to each other. In some embodiments nozzles 110 and 120 are parallel to each other. In some embodiments the shape of the body 106 between each of the multiple nozzles conveys air towards the nozzles by tapering the body towards each nozzle.

In other embodiments of the present disclosure, attachment 100 can have any number of nozzles, such as three, four or five nozzles.

Once attachment 100 is connected to the barrel of a hair dryer, attachment 100 alters the air flow exiting the dryer when the dryer is in use. Specifically, the dual nozzle attachment 100 provides higher exiting air pressure than a single nozzle of equivalent total, effective distal exit area. The total effective distal exit area is the combined area of the distal openings 170 and 180.

Figure 2:
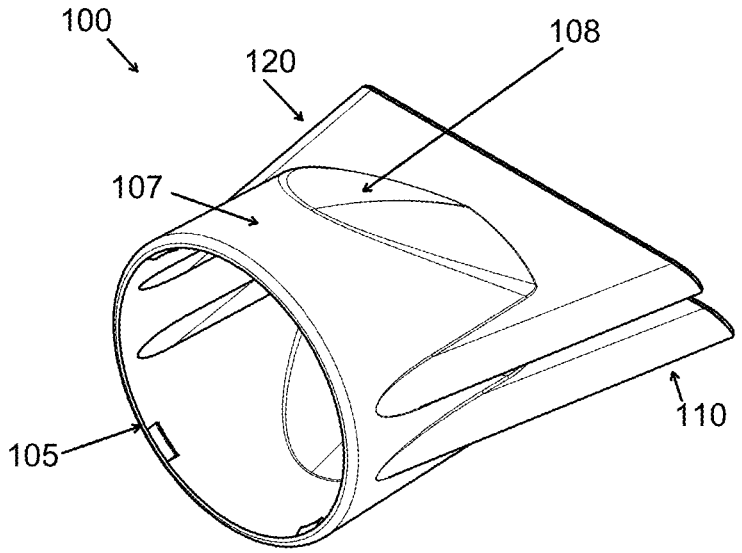
FIG. 2 is a bottom, rear perspective view of the dual nozzle attachment of FIG. 1.
Figure 3:
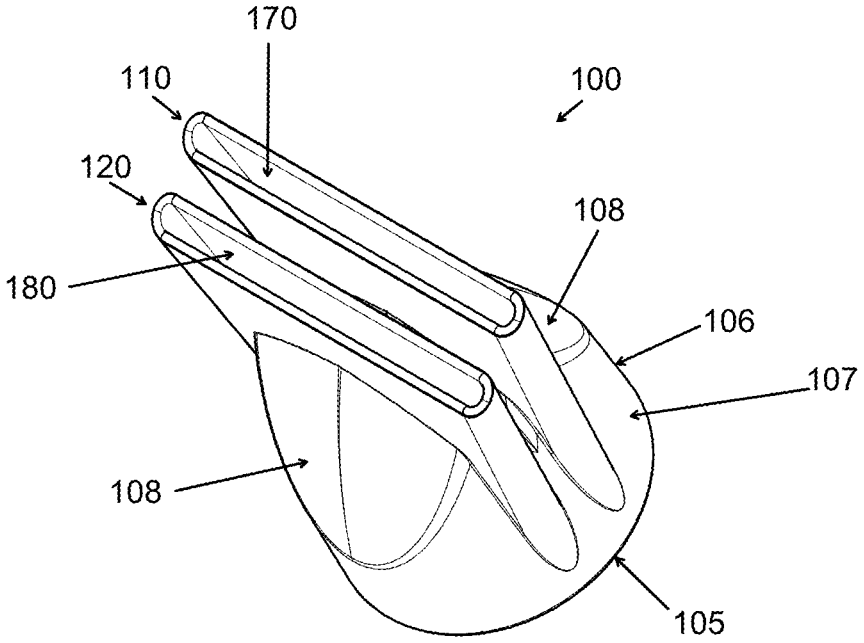
FIG. 3 is a bottom, front perspective view of the dual nozzle attachment of FIG. 1.

Referring to FIGS. 2 and 3, opening 105 is shown as a circular opening in this embodiment, for connection to a hair dryer with a circular barrel. From opening 105, body 106 tapers to connect to the first nozzle 110 and second nozzle 120.

Figure 4:
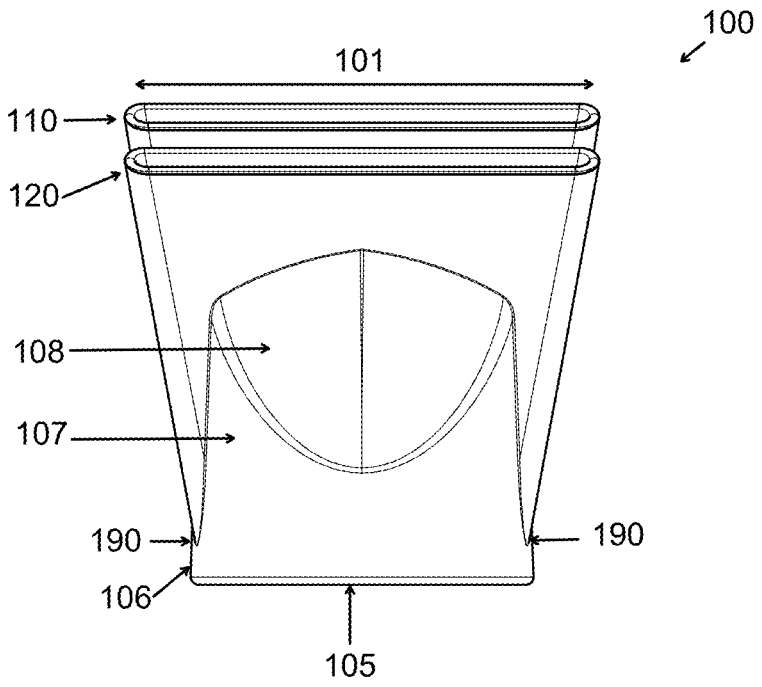
FIG. 4 is a bottom plan view of the dual nozzle attachment of FIG. 1.

Referring to FIG. 4, opening 105 is shown at the bottom of the figure. As shown, body 106 tapers outward and connects to the first and second nozzles 110 and 120, respectively. The distal ends of first and second nozzles 110 and 120 have a length 101. Length 101 is shown as the inner length of the distal end openings 170 and 180 of nozzles 110 and 120. In this embodiment, length 101 is about 60 millimeters (mm) or is 60 (mm). It should be noted that length 101 is the same for first nozzle 110 and second nozzle 120, but in a less preferred embodiment of dual nozzle attachment 100, length 101 can be different for each of the two nozzles.

Figure 5:
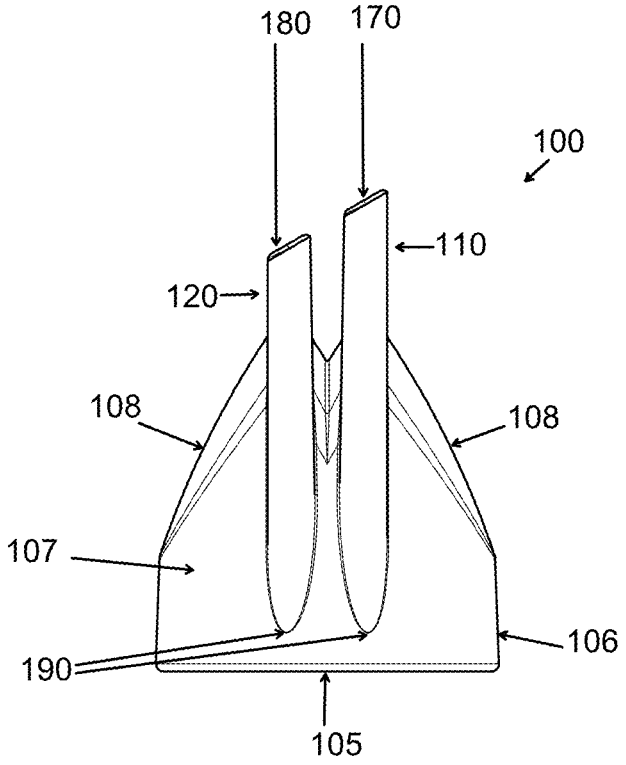
FIG. 5 is a right-side elevational view of the dual nozzle attachment of FIG. 1 (the left side elevational view being a mirror image).

FIG. 5 shows, the right-side of dual nozzle attachment 100. The left-hand side (not shown) would be a mirror image of FIG. 5. In FIG. 5, opening 105 is shown at the bottom of the figure. Body 106 tapers to connect to nozzles 110 and 120 as shown. Nozzle 120 is shorter in length than nozzle 110. The distal ends or tips of nozzles 120 and 110, respectively, are angled and preferably at the same angle as discussed below.

Figure 6:
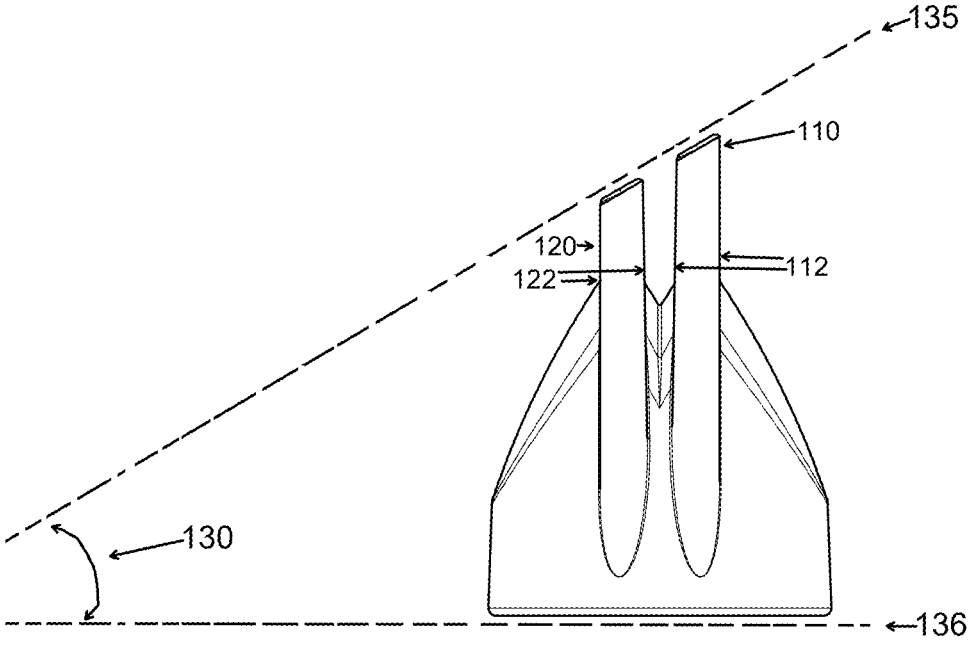
FIG. 6 is the right-side elevational view of the dual nozzle attachment of FIG. 5 further illustrating various angles of the nozzles.

FIG. 6 further illustrates the various angles of distal ends or tips at distal end openings 170 and 180 of nozzles 110 and 120, respectively. An imaginary dotted line 135 is shown adjacent and parallel to distal end openings 170 and 180 of nozzle 110 and 120. Another imaginary line 136 is shown adjacent and parallel to the bottom surface of opening 105, and perpendicular to the sidewalls 112 and 122. Angle 130 is formed at the intersection of lines 135 and 136. In the embodiment shown in FIG. 6, angle 130 is 30 degrees.

Figure 7:
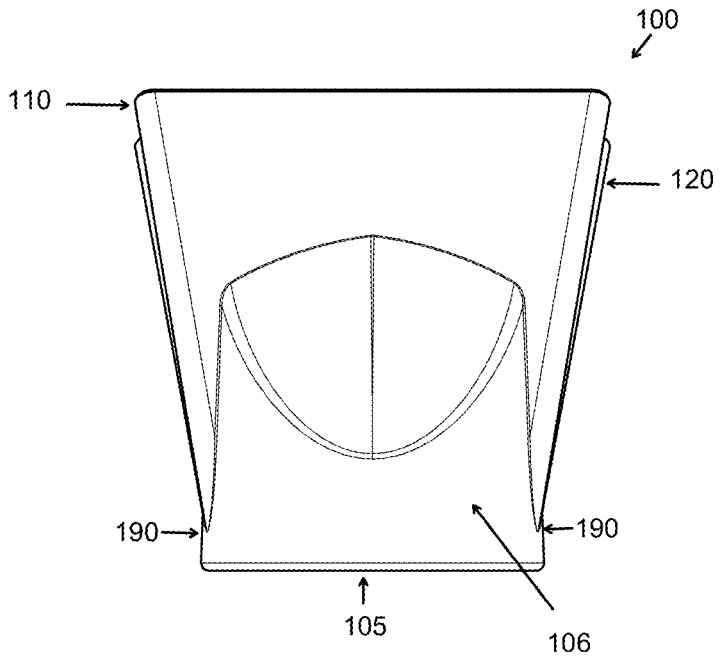
FIG. 7 is a top plan view of the dual nozzle attachment of FIG. 1.

In FIG. 7, first nozzle 110 is shown at the front and second nozzle 120 is shown at the rear. Each nozzle 110 and 120 tapers, in reverse of the taper of body 106, from its greatest width at distal end openings 170 and 180 of nozzles 110 and 120, respectively, to the least width or lowest point 190 of body 106 that is near, but not at opening 105 as shown.

Figure 8:
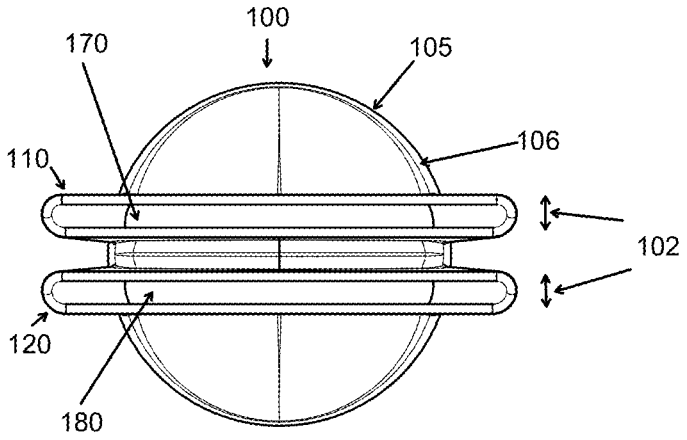
FIG. 8 is a front elevational view of the dual nozzle attachment of FIG. 1.

Referring to FIG. 8, each distal end opening 170 and 180 has a width 102. In the embodiment shown in FIG. 8, width 102 is about 3 millimeters (mm), preferably 3 mm.

Figure 9:
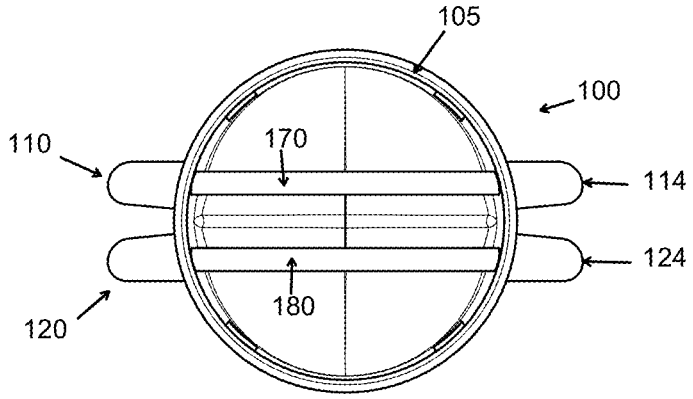
FIG. 9 is a rear elevational view of the dual nozzle attachment of FIG. 1.

As shown in FIG. 9, openings 170 and 180 of nozzles 110 and 120, respectively, are visible from the rear view through opening 105.

Figure 10:
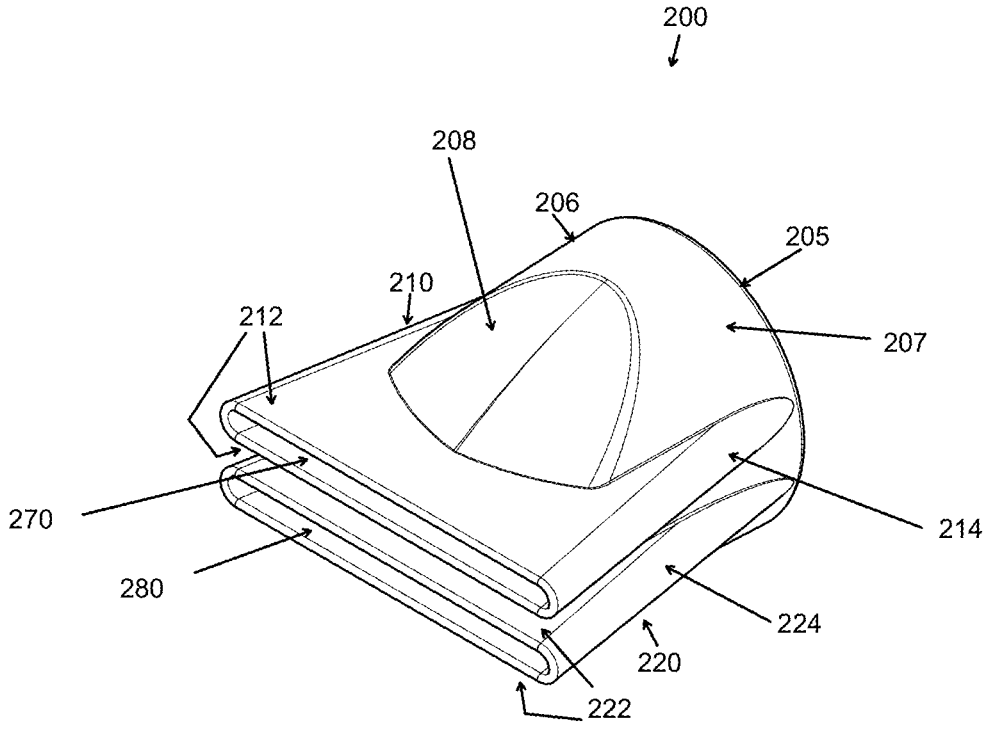
FIG. 10 is a top, front perspective view of a second embodiment of a dual nozzle, nozzle attachment for a hair dryer according to the present disclosure.

FIG. 10 shows a second embodiment of a dual nozzle attachment 200 for a hair dryer according to the present disclosure. In this embodiment, opening 205 of dual nozzle attachment 200 is used to connect to the barrel or concentrator of a hair dryer (not shown). Opening 205 in the embodiment, as shown in FIG. 10, is also circular opening at the rear end of dual nozzle attachment 200. However, in other embodiments, opening 205 can be other shapes, such as rectangular, square, oval, elliptical, and triangular in order to fit hair dryer barrels or concentrators of similar shapes.

Attachment 200 has a first or top nozzle 210 and a second or bottom nozzle 220 both placed at the front end of the attachment as shown. Attachment 200 further has a body 206 tapered from opening 205 to connect with the first and second nozzles 210 and 220. In this second embodiment, body 206 is basically a conical shape with a wider circumference at opening 205 than the circumference at the topmost area that connects to nozzles 210 and 220. In some embodiments the body 206 is the same conical body as described above with regards to body 106 and has similar tapered portions 207 and 208 with respect to tapered portions 107 and 108. In this embodiment, nozzles 210 and 220 are, similar to the nozzles in the first embodiment, shaped as rectangular structures with sidewalls 212 and 222 having curved edges 214 and 224, as shown, and with similarly shaped openings at their distal ends or tips 270 and 280 respectively. However, in this second embodiment, unlike the first embodiment, the proximal ends of nozzles 210 and 220 terminate at the edge 290 or very near the edge of opening 205 as shown more clearly in FIG. 12 and FIG. 14.

In other embodiments of this second embodiment, as discussed above with respect to the first embodiment, attachment 200 can also have additional nozzles, such as a third, fourth or fifth nozzles. Attachment 200 provides higher exiting air pressure than a single nozzle of equivalent total, effective distal exit area. The total effective distal exit area is the combined area of the distal openings 270 and 280.

Figure 11:
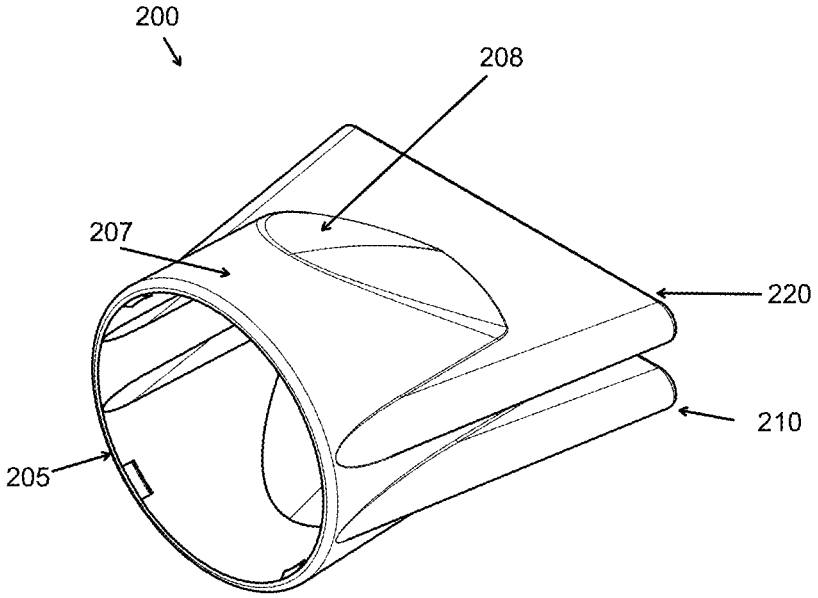
FIG. 11 is a bottom, rear perspective view of the dual nozzle attachment of FIG. 10.
Figure 12:
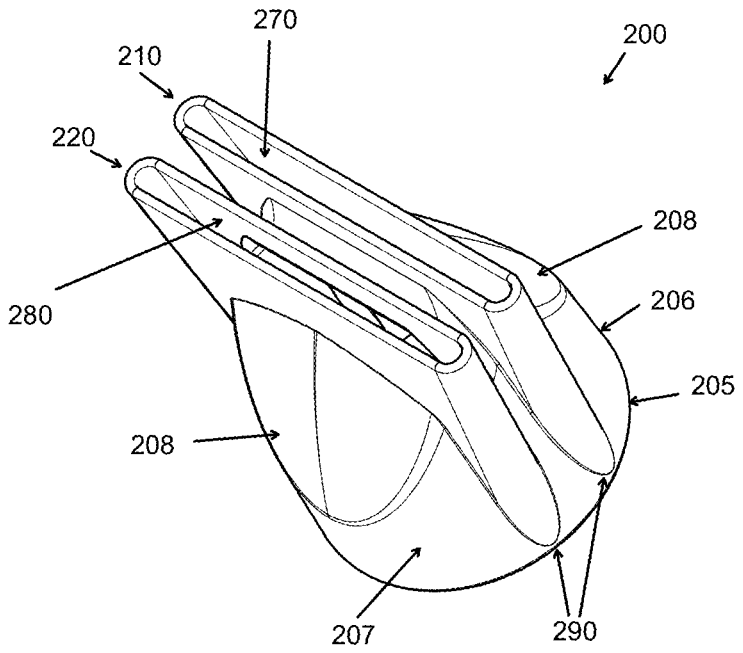
FIG. 12 is a bottom, front perspective view of the dual nozzle attachment of FIG. 10.

As shown in FIGS. 11 and 12, in dual nozzle attachment 200 of this embodiment, opening 205 is, as shown, a circular opening for connection to a hair dryer with a circular barrel. Body 206 tapers to connect to first nozzle 210 and second nozzle 220.

FIG. 12 shows a bottom, front perspective view of the dual nozzle attachment 200 of FIG. 10. The opening 205 is shown as a circular opening for connection to a hair dryer with a circular barrel. Body 206 tapers to connect to the first nozzle 210, and second nozzle 220.

Figure 13:
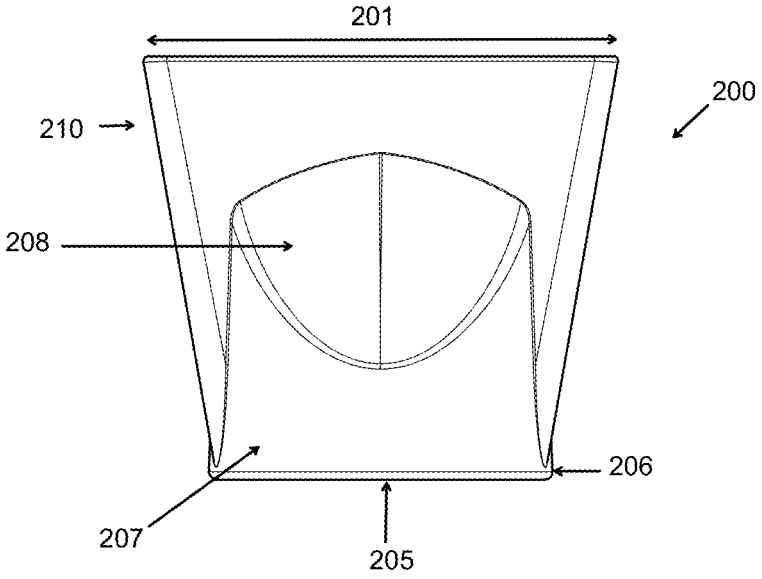
FIG. 13 is a top plan view of the dual nozzle attachment of FIG. 10 (the bottom plan view being a mirror image).

Referring to FIG. 13, opening 205 is shown at the bottom of the figure and body 206 tapers and is connected to first and second nozzles 210 and 220. The distal opening length 201 is shown as the inner width of openings 270 and 280 of nozzles 210 and 220, respectively. In this embodiment, the distal opening length 201 is about 60 (mm) and preferably 60 (mm). Each nozzle 210 and 220 tapers, in reverse of the taper of body 206 from a greatest width at distal end openings 270 and 280 of nozzles 210 and 220.

Figure 14:
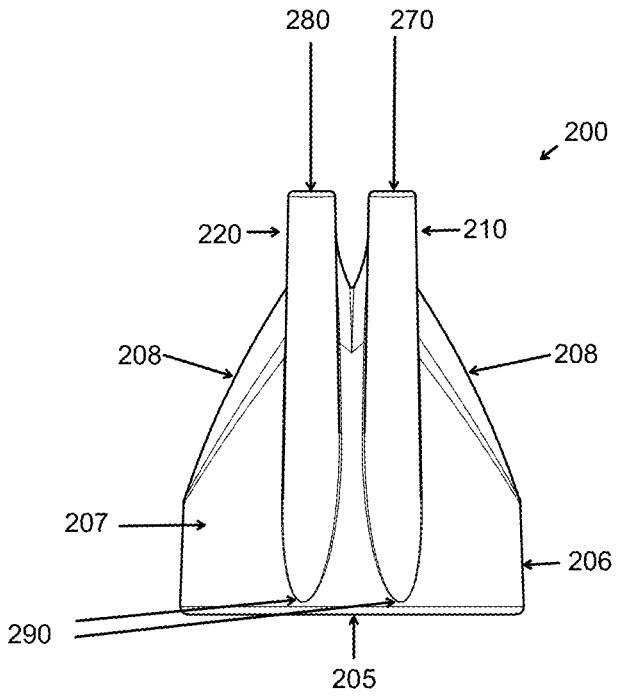
FIG. 14 is a right-side elevational view of the dual nozzle attachment of FIG. 10 (the left side elevational view being a mirror image).

FIG. 14 shows opening 205 of dual nozzle attachment 200 at the bottom of the figure. Body 206 tapers to connect to nozzles 210 and 220 as shown. In this embodiment, nozzle 220 is the same length as nozzle 210. The tips at distal end openings 270 and 280 of nozzles 210 and 220 are positioned coplanar to each other.

Figure 15:
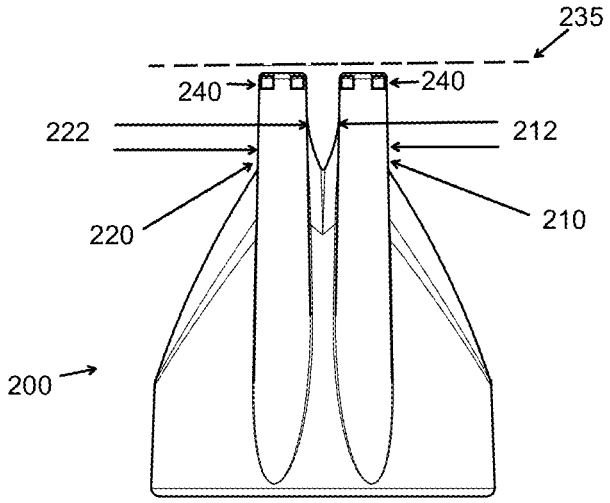
FIG. 15 is the right-side elevational view of the dual nozzle attachment of FIG. 14 further illustrating various angles of the nozzles.

FIG. 15 illustrates the angles of the nozzles 210 and 220. An imaginary dotted line 235 is shown adjacent and parallel to the distal ends 270 and 280 of nozzles 210 and 220. Nozzles 210 and 220 each have sidewalls 212 and 222 respectively that than form right angles 240 with respect to distal ends 270 and 280 of nozzles 210 and 220 as also shown in FIG. 14.

Figure 16:
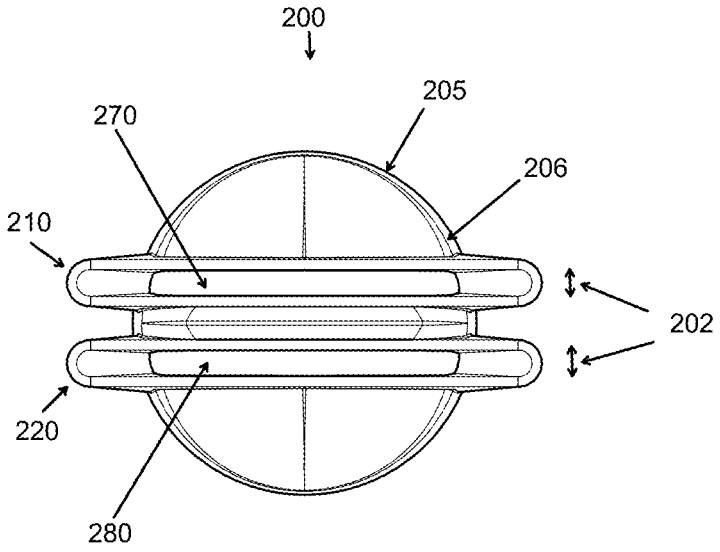
FIG. 16 is a front elevational view of the dual nozzle attachment of FIG. 10.

As shown in FIG. 16, opening 205 is a circular opening and body 206 tapers to connect to both nozzles 210 and 220. The opening of nozzle 210 is 270, and the opening of nozzle 220 is 280. Each opening 270 and 280 has a width 202. In the embodiment shown in FIG. 16, width 202 is about 3.5 (mm) and preferably 3.5 (mm).

Figure 17:
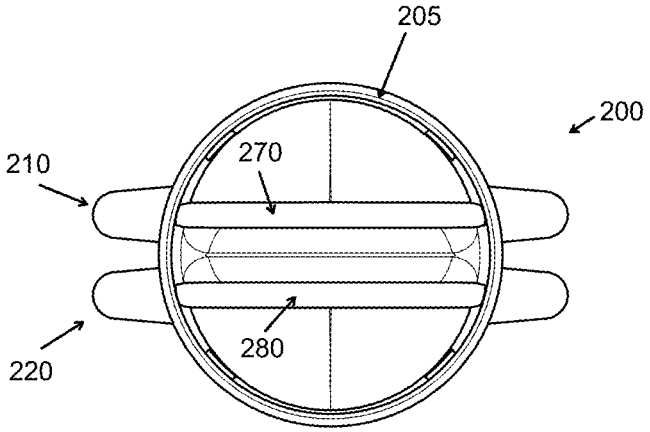
FIG. 17 is a rear elevational view of the dual nozzle attachment of FIG. 10.

As shown in FIG. 17, openings 270 and 280 of nozzles 210 and 220 are visible from the rear view through opening 205.

While the present disclosure has been described with reference to one or more exemplary embodiments, it will be understood by those skilled in the art, that various changes can be made, and equivalents can be substituted for elements thereof without departing from the scope of the present disclosure. In addition, many modifications can be made to adapt a particular situation or material to the teachings of the present disclosure without departing from the scope thereof. Therefore, it is intended that the present disclosure will not be limited to the particular embodiments disclosed herein.

What is claimed is:

1. A multiple nozzle attachment for a hair dryer comprising:

a conical body having a rear portion and a distal portion that is opposite to the rear portion, the distal portion having a front end, the rear portion having a circular diameter that is greater than a circular diameter of the distal portion to form a taper that is symmetrical about a first plane, the circular diameter of the rear portion forms a rear circular opening connectable to a barrel of the hair dryer, the conical body has a conical body interior that receives the barrel of the hair dryer; and only two nozzles centered on the front end of the conical body and each formed by a pair of side walls that are flat and joined on opposite sides by curved edges, each of the two nozzles having a distal end and a proximal end, the two nozzles tapering outward from the conical body so that each of the two nozzles are enlarged at the distal end, the multiple nozzle attachment having a recess formed in between the two nozzles, wherein each distal end forms a tip that has a distal end opening, wherein each distal end opening overlaps the rear circular opening and extends on opposite sides thereof, wherein the pair of side walls each have a length that extends distally outward from the conical body so that the two nozzles protrude outward from the conical body, wherein the only two nozzles comprise a first nozzle and a second nozzle that are adjacent and the pair of side walls of the first nozzle are separate from the pair of side walls of the second nozzle, wherein the two nozzles are generally parallel to each other, and wherein the conical body is continuous and free of openings from the rear circular opening to the nozzles;

wherein each distal end opening has a length and a width, and each length is greater than each width, wherein the tip of the first nozzle and/or the tip of the second nozzle are the most outward extending structures from the conical body, wherein the two nozzles are symmetrical about the first plane, the first plane being perpendicular to the pair of side walls, so that portions of the first nozzle on opposite sides of the first plane mirror one another and portions of the second nozzle on opposite sides of the first plane mirror one another, wherein the conical body interior forms a single open space so that the multiple nozzle attachment has an interior volume that is configured to receive an airflow exiting the barrel of the hair dryer; wherein the airflow inside the interior volume of the conical body is divided into two separate airflows flowing into the first nozzle and the second nozzle.

2. The multiple nozzle attachment of claim 1, wherein the distal end opening of each of the first nozzle and the second nozzle lays in an imaginary nozzle plane, wherein, for each distal end opening, the imaginary nozzle plane formed by the respective distal end opening has at least one elongated edge that is perpendicular to a longitudinal axis, wherein the longitudinal axis passes through the multiple nozzle attachment and is co-linear with a longitudinal axis of the barrel of the hair dryer to which multiple nozzle attachment is attached, and wherein the elongated edge is one of two longer portions of a long, skinny oval formed by each of the distal end openings.

3. The multiple nozzle attachment of claim 1, wherein the distal end openings have approximately the same area as each other.

4. The multiple nozzle attachment of claim 1, wherein the first nozzle is of a different distal length than the second nozzle.

5. The multiple nozzle attachment of claim 1, wherein the distal end opening of each of the first nozzle and the second nozzle lays in an imaginary nozzle plane, and each of the imaginary nozzle planes is positioned at an acute angle relative to an imaginary plane in which the rear circular opening lays.

6. The multiple nozzle attachment of claim 5, wherein each distal end opening of each of the first nozzle and the second nozzle lays in the same imaginary nozzle plane.

7. The multiple nozzle attachment of claim 1, wherein the distal end opening of each of the first nozzle and the second nozzle lays in an imaginary nozzle plane, and each said imaginary nozzle plane is positioned at 30 degrees relative to an imaginary plane in which the rear circular opening lays.

8. The multiple nozzle attachment of claim 7, wherein each distal end opening of each of the first nozzle and the second nozzle lays in the same imaginary nozzle plane.

9. The multiple nozzle attachment of claim 1, wherein the side walls of each pair of side walls are parallel to one another.

10. The multiple nozzle attachment of claim 1, wherein the curved edges of the nozzles extend to adjacent the rear circular opening connectable to the barrel of the hair dryer of the conical body.

11. The multiple nozzle attachment of claim 1, wherein the two nozzles have a shape therebetween that conveys air towards each nozzle by tapering the body towards each nozzle.

* * * * *